US009429352B2

(12) United States Patent
Kim et al.

(10) Patent No.: US 9,429,352 B2
(45) Date of Patent: Aug. 30, 2016

(54) AIR CONDITIONER AND METHOD OF CONTROLLING THE SAME

(71) Applicant: LG Electronics Inc., Seoul (KR)

(72) Inventors: Daehee Kim, Changwon-si (KR); Joonkeol Song, Changwon-si (KR); Sunghwan Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 532 days.

(21) Appl. No.: 13/778,898

(22) Filed: Feb. 27, 2013

(65) Prior Publication Data

US 2013/0239596 A1 Sep. 19, 2013

(30) Foreign Application Priority Data

Feb. 28, 2012 (KR) ..... 10-2012-0020417

(51) Int. Cl.

| | |
|---|---|
| ***F25D 21/02*** | (2006.01) |
| ***F25D 21/14*** | (2006.01) |
| ***F25D 21/04*** | (2006.01) |
| ***F25D 21/06*** | (2006.01) |
| ***F25D 21/00*** | (2006.01) |
| ***F25D 21/08*** | (2006.01) |
| *F24F 11/00* | (2006.01) |

(52) U.S. Cl.

CPC ..... *F25D 21/004* (2013.01); *F25D 21/006* (2013.01); *F25D 21/02* (2013.01); *F25D 21/08* (2013.01); *F24F 2011/0089* (2013.01)

(58) Field of Classification Search

CPC F25D 21/00; F25D 21/14; F24F 2011/0087; F24F 11/0086; F24F 2011/0089; B60H 1/0005; B60H 1/00392; B60H 2001/00128; B60H 2001/00157; F24J 2/40

USPC ..... 62/128, 151–156

See application file for complete search history.

(56) References Cited

U.S. PATENT DOCUMENTS

| | | | | |
|---|---|---|---|---|
| 3,514,735 | A * | 5/1970 | Kiyoichi | F25D 21/02 337/331 |
| 8,033,124 | B2 * | 10/2011 | Han | F25D 21/02 62/151 |
| 2004/0149734 | A1 * | 8/2004 | Petrenko | B60S 1/026 219/538 |
| 2009/0241561 | A1 * | 10/2009 | Han | F25D 21/02 62/80 |

(Continued)

FOREIGN PATENT DOCUMENTS

| | | | |
|---|---|---|---|
| CN | 1693796 | A | 11/2005 |
| CN | 101539348 | A | 9/2009 |
| CN | 101929755 | A | 12/2010 |

(Continued)

*Primary Examiner* — Frantz Jules
*Assistant Examiner* — Meraj A Shaikh
(74) *Attorney, Agent, or Firm* — Dentons US LLP

(57) ABSTRACT

An air conditioner and a method for controlling the same for securing reliability and increasing efficiency are provided. The air conditioner and the method of controlling the same detect freezing occurring in the heat exchanger of the outdoor unit, determine a time of the defrosting operation according to a freezing degree such that the defrosting operation is performed, thereby preventing cooling/heating operation efficiency and capability due to a frequent defrosting operation from being deteriorated. The air conditioner and the method of controlling the same according to the present invention provide comfort of a predetermined level to the user to solve deterioration of convenience, and remove freezing due to a defrosting operation to thereby improve efficiency during cooling/heating operations.

15 Claims, 6 Drawing Sheets

(56) References Cited

U.S. PATENT DOCUMENTS

| | | | | |
|---|---|---|---|---|
| 2011/0107779 | A1* | 5/2011 | Kwak | F25D 21/02 62/140 |
| 2011/0305601 | A1* | 12/2011 | Kawase | F01N 3/2026 422/109 |

FOREIGN PATENT DOCUMENTS

| | | | |
|---|---|---|---|
| CN | 102062751 | A | 5/2011 |
| CN | 102095295 | A | 6/2011 |
| DE | 3308141 | A1 | 9/1984 |
| EP | 0787961 | A2 | 8/1997 |
| EP | 2157380 | A1 | 2/2010 |
| JP | 2001264446 | | 9/2001 |
| KR | 1020080110136 | A | 12/2008 |
| WO | 2008153249 | A1 | 12/2008 |
| WO | 2009093297 | A1 | 7/2009 |

* cited by examiner (a)

(b)

(a)

(b)

AIR CONDITIONER AND METHOD OF CONTROLLING THE SAME

CROSS-REFERENCE TO RELATED APPLICATION

This application claims the priority benefit of Korean Patent Application No. 10-2012-0020417, filed on Feb. 28, 2012 in the Korean Intellectual Property Office, the disclosure of which is incorporated herein by reference.

BACKGROUND OF THE INVENTION

1. Field of the Invention

The present invention relates to an air conditioner and a method of controlling the same, and more particularly, to an air conditioner for detecting freezing inside the air conditioner to protect an outdoor unit and a method of controlling the same.

2. Description of the Related Art

In general, an air conditioner cools and heats indoor using a refrigerating cycle of a refrigerant formed with a compressor, a condenser, an expanding device, and an evaporator in order to provide more comfortable indoor environment to a user.

In an industrial air conditioner or a central air conditioner, a cooler formed with a compressor, a condenser, an expansion device, and an evaporator cools water and conditions indoor air of a large building such as a building, a factory, or a sports center using the cooled water.

In such an air conditioner, an outdoor unit is installed outdoors and an operation of the outdoor unit may be influenced by weather or an outdoor temperature. In particular, in a heat exchanger included in an outdoor unit, when the outdoor unit performs a cooling operation or a heating operation, freezing where water generated due to heat exchange is frozen on a surface of a heat exchanger occurs.

Freezing occurring on the surface of the heat exchanger deteriorates heat exchange efficiency which results in deterioration of an operation efficiency of the air conditioner. To solve the above problem, an outdoor unit performs a defrosting operation. When the defrosting operation is performed, cooling or heating operation into the indoor is impossible so that a user experiences inconvenience.

SUMMARY OF THE INVENTION

The present invention has been made in an effort to solve the above problems, and the present invention provides an air conditioner for detecting freezing generated from a heat exchanger inside an outdoor unit and controlling a defrosting operation according to a freezing degree, and a method of controlling the same.

According to an aspect of the present invention, there is provided an air conditioner including: a compressor; a heat exchanger performing heat exchange between a refrigerant and air through movement of the air; a frost formation detector provided in the heat exchanger for detecting a frost formation degree in the heat exchanger to output a detection signal; and a controller computing a frost formation level due to freezing in the heat exchanger according to the detection signal inputted from the frost formation detector, and controlling the compressor according to the frost formation level to perform a defrosting operation.

According to another aspect of the present invention, there is provided method of controlling an air conditioner, including: receiving a detection signal changed according to contacts between a plurality of electrodes of a frost formation detector installed in a heat exchanger while the air conditioner is operating; computing a frost formation level corresponding to the detection signal; performing a defrosting operation when the frost formation level is equal to or greater than a reference value; and returning to a general operation when the defrosting operation is performed for a predetermined time or when the frost formation level is less than the reference value.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF THE PREFERRED EMBODIMENT

Hereinafter, exemplary embodiments according to the present invention will be described in detail with reference to the accompanying drawings. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art. The same reference numbers are used throughout the drawings to refer to the same or like parts. Detailed descriptions of well-known functions and structures incorporated herein may be omitted to avoid obscuring the subject matter of the present invention.

Hereinafter, an air conditioner and a method of controlling the same according to embodiments of the present inventions will be described with reference to the accompanying drawings.

Figure 1:
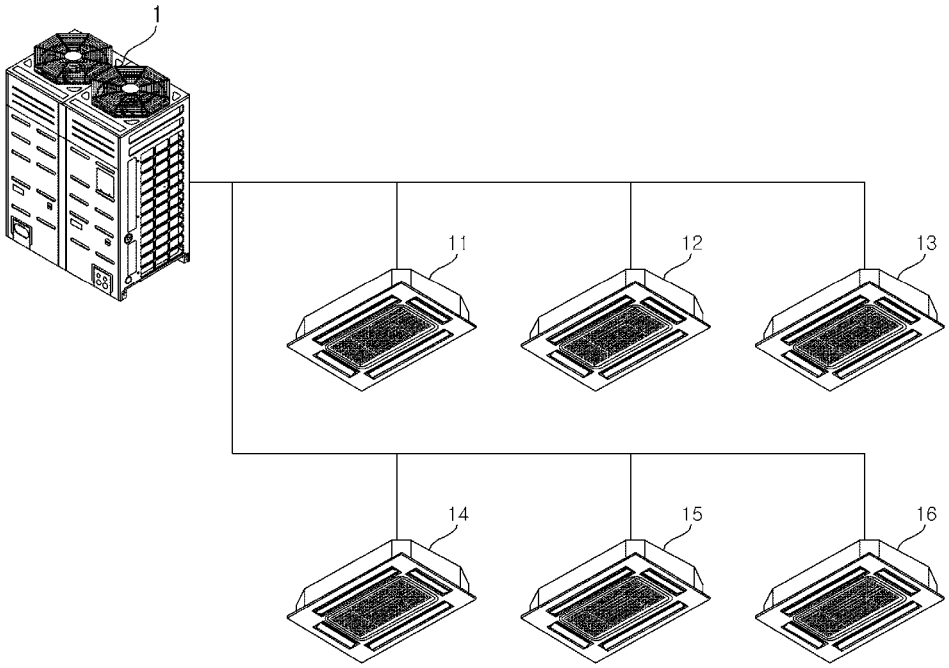
FIG. 1 is a view illustrating an air conditioner according to an exemplary embodiment of the present invention.

FIG. 1 is a view illustrating an air conditioner according to an exemplary embodiment of the present invention.

Referring to FIG. 1, an air conditioner includes an outdoor unit 1 and a plurality of indoor units 11 to 16.

The indoor units 11 to 16 may condition indoor air and be simultaneously or independently operated according to an indoor air conditioning load.

The air conditioner may include a ventilation unit and an air cleaning unit for mixing fresh outdoor air with internally circulated indoor air.

The indoor units 11 to 16 are connected to the outdoor unit 1 through a refrigerant pipe and a communication line, receive a refrigerant, and communicate with the outdoor unit 1.

Each of the indoor units 11 to 16 includes an indoor heat exchanger (not shown), an indoor fan (not shown), and an expansion valve (not shown) in which a supplied refrigerant is expanded, and a plurality of sensors (not shown).

The outdoor unit 1 includes a compressor (not shown) receiving a refrigerant and compressing, an outdoor heat exchanger (not shown) heat-exchanging the refrigerant with outdoor air, an accumulator (not shown) extracting gas refrigerant from the supplied refrigerant and providing the extracted gas refrigerant to the compressor, and a 4-way valve (not shown) selecting a flow passage of the refrigerant according to a heating operation.

The outdoor units 11 to 16 may further include an outdoor fan (not shown) moving outdoor air to an outdoor heat exchanger (not shown), an outdoor temperature sensor (not shown) detecting an outdoor temperature, and a snowfall detector detecting a snowfall amount outside the outdoor unit 10.

The outdoor unit 10 further includes a plurality of sensors, valves, and oil recovery devices but a description thereof is omitted below.

Figure 2:
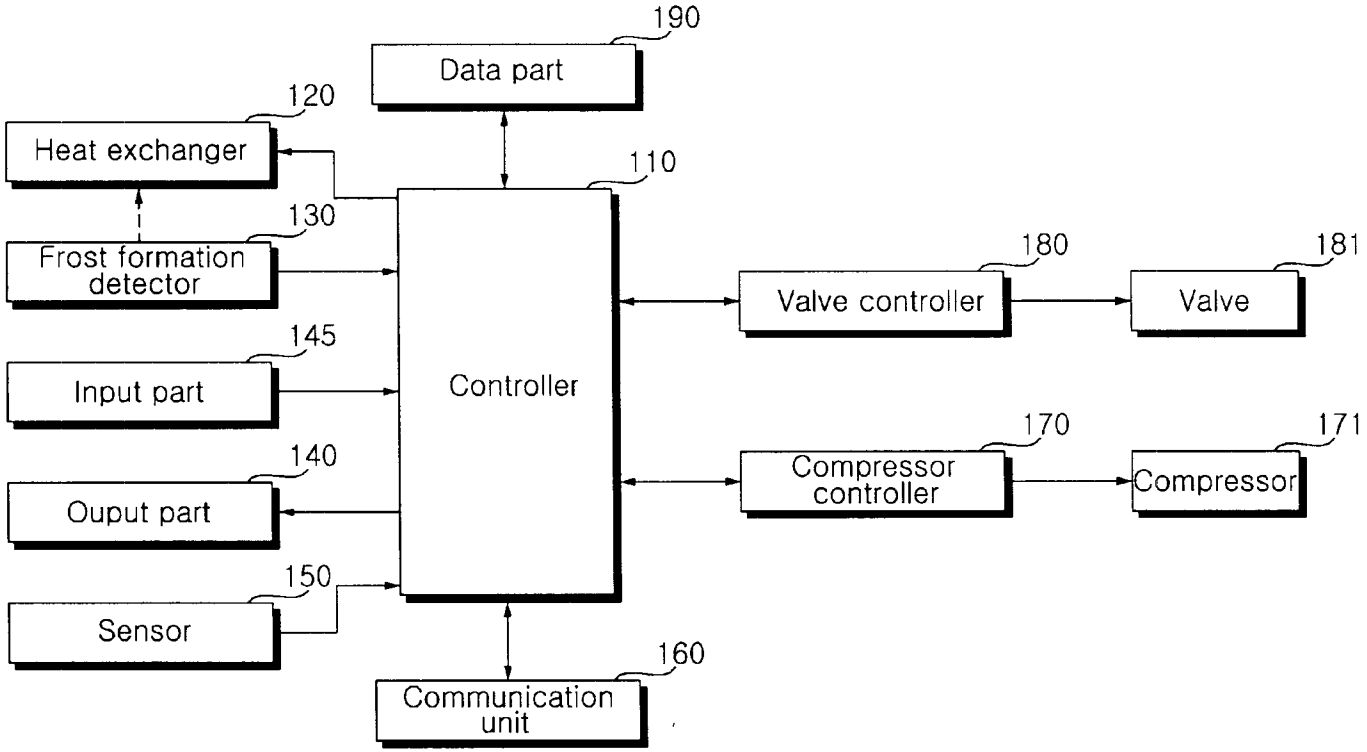
FIG. 2 is a block diagram schematically illustrating a control configuration of an outdoor unit of an air conditioner according to an exemplary embodiment of the present invention.

FIG. 2 is a block diagram schematically illustrating a control configuration of an outdoor unit of an air conditioner according to an exemplary embodiment of the present invention.

Referring to FIG. 2, an outdoor unit of the air conditioner constructed as illustrated includes a compressor 171, a compressor controller 170, an outdoor fan 181, a valve controller 180, a data part 190, a communication part 160, a heat exchanger 120, a frost formation detector 130, an output part 140, a sensor 150, and a controller 110 controlling an overall operation of the outdoor unit.

The input part 145 includes at least one switch and inputs a signal according to operation on/off of the outdoor unit and setting with respect to an operation of the outdoor unit. The input part 120 sets an address or a mode of outdoor unit according to setting of the switch.

The output part 140 outputs presence of an operation or a communication state of the outdoor unit and outputs a specific effect sound and an alarm sound in some cases.

The sensor 150 includes a plurality of sensors, and is mounted inside or outside the outdoor unit, and measures a temperature and pressure of a refrigerant, and temperatures of respective parts of the outdoor unit and inputs the measured temperatures and the pressure of the refrigerant, and the measured temperatures of respective parts of the outdoor unit 1 to the controller 110. The sensor 150 detects a flow rate of the refrigerant and inputs the detected flow rate of the refrigerant to the controller 110.

The frost formation detector 130 is installed in the heat exchanger 120, and detects a frosting degree in the heat exchanger 120. In this case, the frost formation detector 130 detects freezing in the heat exchanger 120, namely, presence of formation and a formation degree of frost or ice.

The heat exchanger 120 heat-exchanges air moving by an outdoor fan 181 with the refrigerant. In this case, water generated due to a temperature difference is formed and is frozen to the frost or ice in the heat exchanger during a heat exchanging procedure.

The frost formation detector 130 detects freezing on a surface of the heat exchanger 120.

The compressor controller 170 controls the compressor 171 to be operated and controls an operation frequency of the compressor 171.

The valve controller 180 controls opening/closing and a degree thereof of a plurality of valves 181. A fan controller (not shown) controls an outdoor fan 181 to be rotated, and controls rotating speed of the outdoor fan 181 to control movement of air in the heat exchanger 120.

The communication part 160 transceives data with another outdoor unit or an indoor unit, and communicates with a central controller in some cases.

The data part 190 accumatively stores data detected or measured by the sensor 150 and the frost formation detector 130. The data part 190 stores control data for controlling an operation of an outdoor unit and reference data for determining failure.

The controller 100 provides a control command to the compressor controller 170 according to input data such that the compressor 171 is operated. The controller 110 operates the outdoor fan 181 and controls movement of a refrigerant through valve control by the valve controller 180.

The controller 100 operates the compressor 171 and the outdoor fan 181, determines failure of an operation of the outdoor unit 1, and outputs an operation state to the output part 140 according to input data from the sensor 150.

The controller 110 controls an operation of the outdoor unit 1 according to a frost formation value inputted from the frost formation detector 130. The controller 110 controls the outdoor unit to perform a defrosting operation according to a degree of frost formation, namely, a freezing degree in the heat exchanger.

In this case, the controller 110 converts data inputted from the frost formation detector 130, compares the converted data with reference data, and determines a degree of frost formation based on the comparison result. If the converted data is equal to or greater than the reference data, the controller 110 provides a control command to the compressor controller 170 such that the outdoor unit performs a defrosting operation.

The controller 110 determines a snowfall amount corresponding to a detection signal inputted from the frost formation detector 130. The controller 100 compares the detection signal of the frost formation detector 130 with reference data stored in the data part 190 and determines a frost formation degree based on the comparison result. The controller 110 may classify magnitude of the detection signal into a plurality of levels and determine a frost formation level as one of the levels.

If it is determined that a defrosting operation is required, the controller 110 performs a defrosting operation for a predetermined time and again operates the air conditioner in a designated operation mode, and again performs the defrosting operation according to the detection signal inputted through the frost formation detector 130.

Because normal cooling/heating operations are impossible during a defrosting operation, the controller 110 confirms a time point of a defrosting operation according to a detection signal of the frost formation detector 130 such that an operating time of the defrosting operation or the number of times of defrosting operations is minimized.

When the defrosting operation is performed for greater than a predetermined time, the controller 110 returns to a general operation and performs the cooling/heating operations even if a frost formation level is equal to or greater than a predetermined value.

In this case, when the number of times of the defrosting operations performed within a period or a predetermined time of the defrosting operation is equal to or greater than a reference value, the controller 110 changes the reference value or a time of the defrosting operation.

Figure 3:
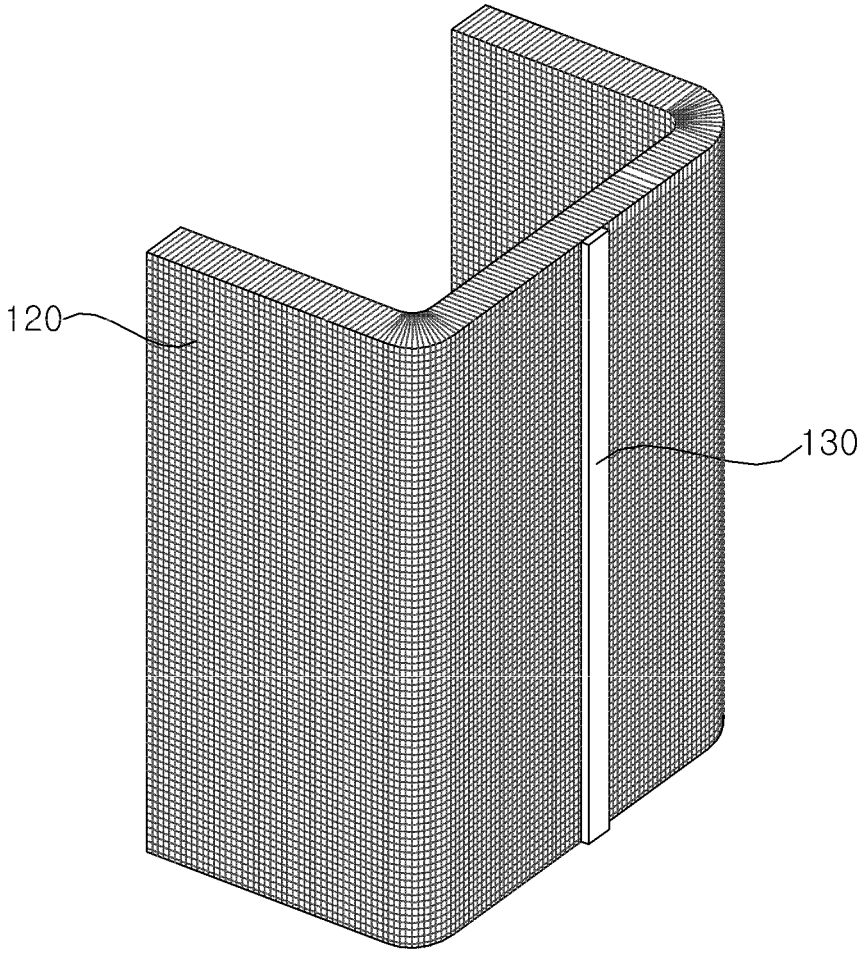
FIG. 3 is a view illustrating a heat exchanger of an air conditioner according to an exemplary embodiment of the present invention.

FIG. 3 is a view illustrating a heat exchanger of an air conditioner according to an exemplary embodiment of the present invention. For example, a following description will be made on the assumption that the heat exchanger has a 'ㄴ' shape as illustrated in FIG. 3 such that heat exchange efficiency is improved by maximizing a contact area with air.

As shown, the following description will be made on the assumption that the frost formation detector 130 is longitudinally installed in the center of the heat exchanger 120 by way of example.

In general, because freezing in the heat exchanger 120 is formed from a lower end to an upper end according to flow direction of the refrigerant, the frost formation detector 130 is longitudinally installed and detects freezing which is generated from the lower end of the frost formation detector 130 and progresses to the upper end thereof.

In this case, the foregoing embodiment has illustrated that the frost formation detector is installed in a central portion of the heat exchanger by way of example. However, the present invention is not limited thereto. That is, it is apparent that the frost formation detector may be installed in a left side or a right side of the heat exchanger 120.

Figure 4:
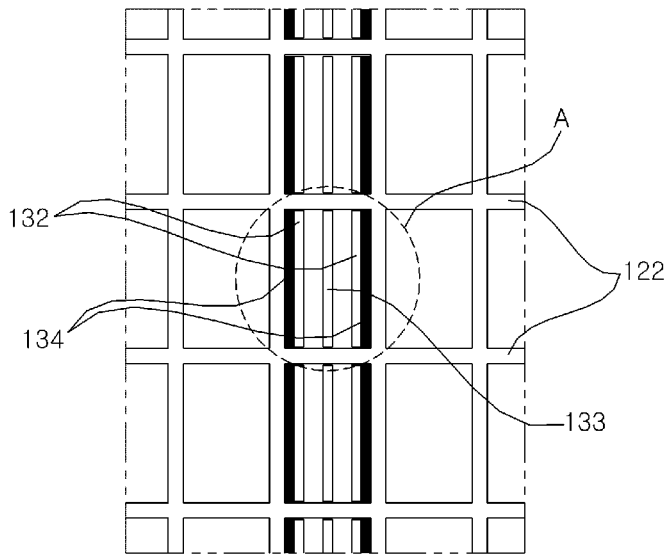
FIG. 4 is a view illustrating a configuration of a frost formation detector installed in a heat exchanger.
Figure 4:
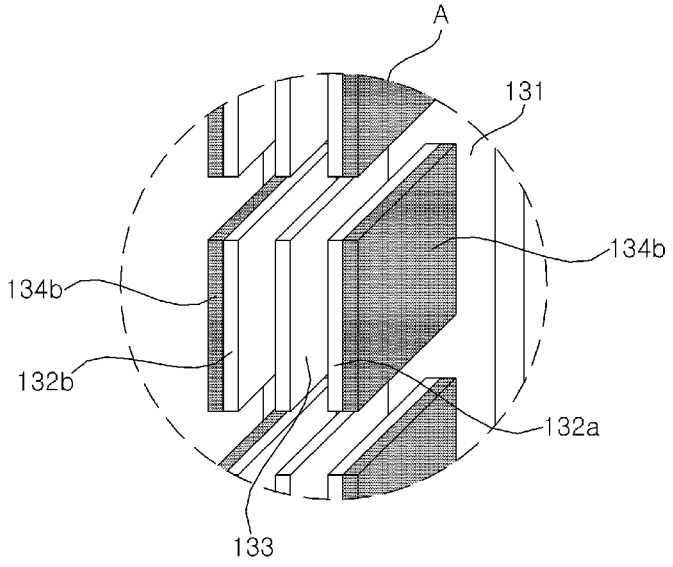

FIG. 4 is a view illustrating a configuration of a frost formation detector installed in a heat exchanger.

Referring to FIG. 4(*a*), a frost formation detector 130 is longitudinally installed in the heat exchanger 120. In this case, the frost formation detector 130 is configured suited to intervals of copper pipes 122 of the heat exchanger. In some cases, intervals of copper pipes 122 may be changed such that the frost formation detector 130 is mounted in one side of the heat exchanger 120.

In this case, the frost formation detector 130 has a structure which is coupled between fins of the heat exchanger.

The frost formation detector 130 include a plurality of electrodes 132 and 133 and insulation parts 134.

The electrodes 132 and 133 protrude from a body 131 of the frost formation detector 130 which is longitudinally in the heat exchanger 120.

In this case, the electrodes 132 and 133 are configured parallel to a copper pipe in a longitudinal direction of the heat exchanger 120, and are a plurality of layers formed from a lower end of the body 131 to an upper end thereof.

The electrodes 132 are respectively provided at a left side and a right side of the body 131, and the electrode 133 is provided at a central portion of the body 131, so that three electrodes are configured in one layer. The sizes of respective electrodes and intervals between layers of the respective layers may be changed according to the size of a copper pipe of the heat exchanger 120.

The insulation parts 134 are provided in left and right electrodes in a direction of the copper pipe 122 of the heat exchanger 120, respectively.

As shown in FIG. 4*b*, insulation parts 134*a* and 134*b* are provided in outer sides of the first and second protruding electrodes 132*a* and 132*b*, namely, in a direction of a copper pipe of the heat exchanger 120. A third electrode 133 is provided at a central portion of a body.

The first to third electrodes 132 and 133 are provided parallel to each other. In this case, the first and second electrodes 132 are bent.

In this case, in the frost formation detector 130, the first and second electrodes 132 do not make contact with the copper pipe 122 of the heat exchanger 124 but the insulation part 134 makes contact with the heat exchanger 120.

When frost is generated to generate freezing or water is frozen due to generation of water in the copper pipe 122 of the heat exchanger 120, the first and second electrodes 132 are bent in a direction of the third electrode 133 of a central portion.

If a frozen amount is increased, bending of the first and second electrode 132 is increased so that the first or second electrodes 132 make contact with the third electrode 133.

If the first electrode 132 or the second electrode 132 is connected to the third electrode 133 by making contact with the third electrode 133, the frost formation detector 130 generates and provides a detection signal of predetermined amplitude to the controller 110.

In this case, the frost formation detector 130 is connected to a resistor of a predetermined size for each layer. Accordingly, because the number of internally connected resistors is different according to coupling of electrodes between layers, different detection signals are provided to the controller 110 according to contact electrodes.

The controller 110 classifies a level of the detection signals into a plurality of levels according to amplitudes of the detection signals to determine a frost formation level. The classification of the frost formation level according to the amplitudes of the detection signals may be achieved according to reference data stored in the data part.

Accordingly, the following is a circuit arrangement of the frost formation detector 130.

Figure 5:
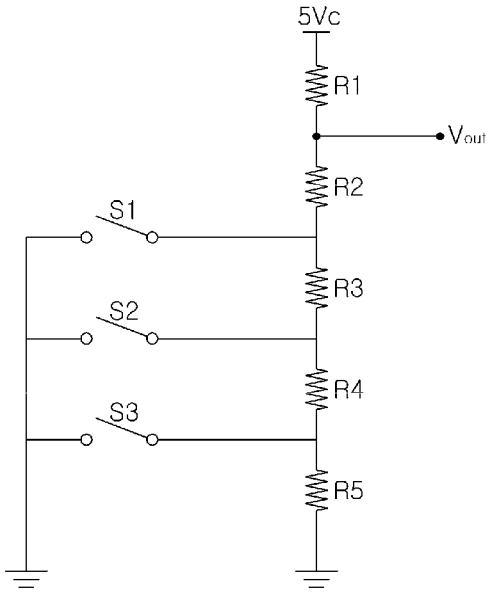
FIG. 5 is a circuit diagram illustrating a configuration of the frost formation detector.
Figure 5:
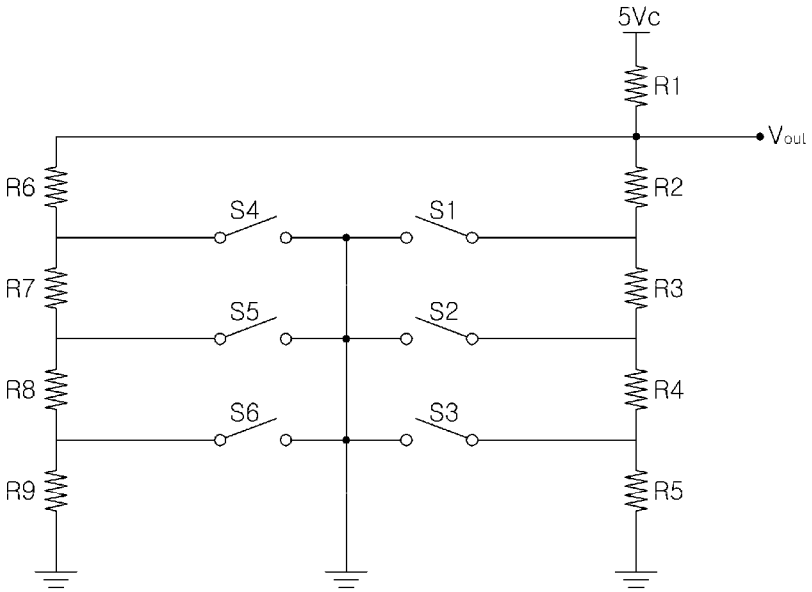

FIG. 5 is a circuit diagram illustrating a configuration of the frost formation detector. FIGS. 5(*a*) and (*b*) are examples of a circuit arrangement of the frost formation detector, and connection and a configuration thereof may be changed.

The first to third electrodes act as a switch, and an internal circuit is connected to the first to third electrode so that a detection signal of predetermined magnitude is provided to the controller when the electrodes make contact with each other according to freezing in the heat exchanger.

As shown in FIG. 5(*a*), a plurality of resistors is connected to the first to third electrodes, and electrodes by layers of the frost formation detector 130 separately operate as a switch, respectively.

That is, the first to third electrodes are internally connected to resistors and operate as a first switch S1, and another electrode provided at lower ends of the first to third electrodes acts as a second switch S2.

Since a switch configured by a plurality of electrodes is turned-on according to a freezing degree to configure an internal circuit as electrodes make contact with each other from a lower end, and the number of resistors in a path is changed according to a switched location, a value of a detection signal Vout in which a voltage is divided and the divided voltage is outputted is changed.

For example, if the third switch S3 is turned-on, a voltage with respect to a fifth resistor R5, and second to fourth resistors R2, R3, and R4 is divided and a detection signal Vout is outputted. If the second and third switches S2 and S3 are turned-on, the fourth and fifth resistors are connected to each other in parallel so that a voltage divided with respect to the second and third resistors R2 and R3 is outputted as the detection signal Vout.

As shown in FIG. 5(*b*), a circuit may be configured in which two switches are provided in one layer in such a way that a first electrode and a third electrode constitutes one switch S1 and a second electrode and the third electrode constitutes one switch S4.

One switch is connected so that a detection signal having predetermined magnitude whose voltage is divided is outputted.

The controller 110 may determine a frost formation degree, namely, a degree by which freezing occurs in the heat exchanger according to magnitude of a voltage of the detection signal.

When a voltage of the detection signal is equal to or greater than a reference value, the controller 110 provides a control signal to a compressor controller 170 such that a defrosting operation is performed.

For example, if it is determined that a freezing degree determined according to the detection signal is equal to or greater than ½ of the heat exchanger, the controller 100 may instruct the defrosting operation.

The reference value may be changed according to at least one of peripheral environments in which the outdoor unit is provided, an outdoor temperature, an indoor temperature, or a season.

Figure 6:
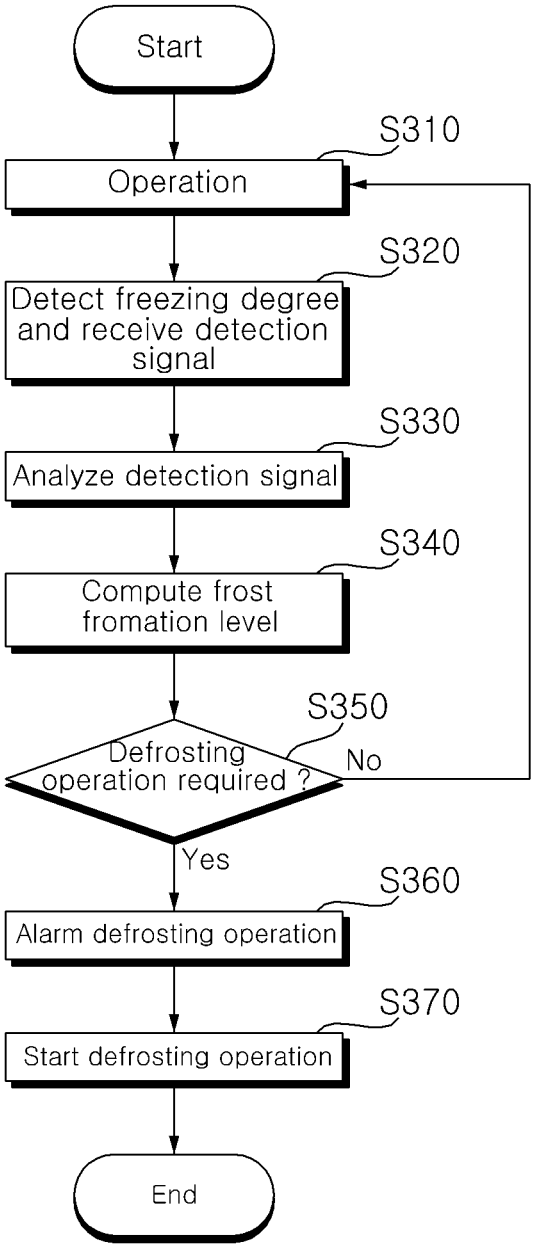
FIG. 6 is a flowchart illustrating a method of detecting frost formation in a heat exchanger and controlling an air conditioner according to an exemplary embodiment of the present invention.

FIG. 6 is a flowchart illustrating a method of detecting frost formation in a heat exchanger and controlling an air conditioner according to an exemplary embodiment of the present invention.

Referring to FIG. 6, an air conditioner detects a freezing degree in a heat exchanger by a frost formation detector 130 during an operation (S310) and receives a detection signal (S320).

The controller 110 analyzes the detection signal (S330) and computes a frost formation level indicating the freezing degree (S340).

The controller 110 determines whether a defrosting operation is required by comparing the computed frost formation level with a preset reference value (S350).

When it is determined that the defrosting operation is required, the controller 110 outputs a message indicating that the defrosting operation is performed through a display part. In this case, an output part may output a message or an effect sound according to the defrosting operation, or a defrosting operation alarm message. In some cases, the outdoor unit transmits the defrosting operation alarm message to the indoor unit through a communication unit so that an alarm with respect to the defrosting operation is outputted through the indoor unit.

The controller 100 provides a control command to the compressor controller 170 so that the defrosting operation starts (S370).

The controller 110 performs the defrosting operation for a predetermined time, returns to a general operation mode according to setting, and performs cooling/heating operations.

The controller 110 may detect frost formation through the frost formation detector 130 during the defrosting operation and determine a frost formation level according to an input detection signal to determine whether to maintain the defrosting operation.

In this case, it is preferable that a criterion of determining stop of the defrosting operation is set lower than a frost formation level in a case of starting the defrosting operation. In some cases, when freezing is not solved for a predetermined time, the defrosting operation may stop and then restart a predetermined time later.

The controller 110 continuously determines a freezing degree in the heat exchanger through the frost formation detector during an operation to perform a defrosting operation.

Accordingly, the air conditioner detects a degree of freezing occurring in the heat exchanger of an outdoor unit to perform a defrosting operation, thereby preventing heat exchange efficiency due to freezing in the heat exchanger from being deteriorated. Further, a defrosting operation is more efficiently performed so that more comfortable indoor environment may be provided while performing the defrosting operation.

The air conditioner and the method of controlling the same according to the present invention detect freezing occurring in the heat exchanger of the outdoor unit, determine a time of the defrosting operation according to a freezing degree such that the defrosting operation is performed, thereby preventing cooling/heating operation efficiency and capability due to a frequent defrosting operation from being deteriorated. The air conditioner and the method of controlling the same according to the present invention provide comfort of a predetermined level to the user to solve deterioration of convenience, and remove freezing due to a defrosting operation to thereby improve efficiency during cooling/heating operations.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An air conditioner comprising:

a compressor;

a heat exchanger performing heat exchange between a refrigerant and air through movement of the air;

a frost formation detector provided in the heat exchanger for detecting a frost formation degree in the heat exchanger and to output a detection signal based on the frost formation degree; and a controller configured to compute a frost formation level due to freezing in the heat exchanger according to the detection signal inputted from the frost formation detector, and to perform a defrosting operation according to the frost formation level, wherein the frost formation detector comprises a plurality of switches, wherein the switches are arranged in a body provided at the heat exchanger;

wherein each switch comprises:

layers of electrodes spaced apart from each other by air; and insulation parts for insulating the layers of electrodes from the heat exchanger, wherein each of the layers of electrodes comprises two outer electrodes spaced apart from a central electrode, wherein one terminal of each of the electrodes is fixed to the body, and another terminal of each electrode is inserted into the heat exchanger, so that the outer electrodes are configured to turn the switches on by bending towards and making contact with the central electrode due to the freezing in the heat exchanger.

2. The air conditioner of claim 1, wherein the controller is configured to classify a magnitude of the detection signal into a plurality of levels and to determine a frost formation level as one of the levels.

3. The air conditioner of claim 1, wherein the frost formation detector comprises a circuit arrangement comprising a plurality of resistors and the plurality of switches, wherein the resistance of the circuit arrangement is changed according to whether any of the switches are turned on so that detection signals having different magnitudes are outputted to the controller based on the number of switches turned on.

4. The air conditioner of claim 1, wherein the insulation parts are disposed on outer sides of the two outer electrodes.

5. The air conditioner of claim 1, wherein the layers of electrodes are formed from a lower end of the body to an upper end of the body.

6. The air conditioner of claim 5, wherein the layers of electrodes are provided parallel to a longitudinal pipe of the heat exchanger.

7. The air conditioner of claim 5, wherein the freezing of the heat exchanger occurs sequentially from the lower end of the body to the upper end of the body so that the number of contacting electrodes is increased as the freezing of the heat exchanger moves upwards.

8. The air conditioner of claim 1, wherein when the frost formation level is equal to or greater than a preset reference value, the controller performs the defrosting operation for a predetermined time and then returns to a general operation.

9. The air conditioner of claim 1, wherein the controller performs the defrosting operation when the frost formation level is equal to or greater than a preset reference value, and the controller returns to a general operation when a frost formation level detected by the frost formation detector is less than a predetermined value.

10. A method of operating an air conditioner comprising a compressor, a heat exchanger performing heat exchange between a refrigerant and air through movement of the air, a frost formation detector provided in the heat exchanger and a controller and wherein the method comprises the steps of:

detecting a frost formation degree in the heat exchanger by the frost formation detector;

outputting a detection signal that is based on the frost formation degree by the frost formation detector;

computing a frost formation level due to freezing in the heat exchanger according to the detection signal transmitted from the frost formation detector to the controller; and performing a defrosting operation according to the frost formation level using the controller, wherein the frost formation detector operates via a plurality of switches, wherein the switches are arranged in a body provided at the heat exchanger, and wherein each switch comprises:

layers of electrodes spaced apart from each other by air; and insulation parts for insulating the layers of electrodes from the heat exchanger, wherein each of the layers of electrodes comprises two outer electrodes spaced apart from a central electrode, wherein one terminal of each of the electrodes is fixed to the body, and another terminal of each electrode is inserted into the heat exchanger, so that the outer electrodes are configured to turn the switches on by bending towards and making contact with the central electrode due to the freezing in the heat exchanger.

11. The method of claim 10, further comprising:

receiving a detection signal from the frost formation detector installed in a heat exchanger while the air conditioner is operating;

computing a frost formation level corresponding to the detection signal;

performing a defrosting operation when the frost formation level is equal to or greater than a reference value; and returning to a general operation when the defrosting operation is performed for a predetermined time or when the frost formation level is less than the reference value.

12. The method of claim 11, further comprising:

returning to a general operation when the computed frost formation level is equal to or greater than the reference value and the defrosting operation is performed for the predetermined time during the defrosting operation.

13. The method of claim 11, further comprising:

computing the frost formation level according to the detection signal periodically inputted during the general operation to perform the defrosting operation.

14. The method of claim 11, further comprising:

changing the reference value or an operation time of the frost formation operation when the number of times of defrosting operations within a predetermined time is equal to or greater than a reference number of times.

15. The method of claim 11, wherein the detection signal is changed according to contacts between a plurality of electrodes of the frost formation detector.

* * * * *